US008364339B2

(12) United States Patent
Willard et al.

(10) Patent No.: US 8,364,339 B2
(45) Date of Patent: Jan. 29, 2013

(54) ENGINE MONITORING

(75) Inventors: Alexander Edward Willard, Kelvedon (GB); Emmanouil Hatiris, Kelvedon (GB)

(73) Assignee: Lysanda Limited, Kelvedon, Essex (GB)

( * ) Notice: Subject to any disclaimer, the term of this patent is extended or adjusted under 35 U.S.C. 154(b) by 395 days.

(21) Appl. No.: 12/602,170

(22) PCT Filed: May 30, 2008

(86) PCT No.: PCT/GB2008/001870

§ 371 (c)(1),
(2), (4) Date: Nov. 30, 2009

(87) PCT Pub. No.: WO2008/146020

PCT Pub. Date: Dec. 4, 2008

(65) Prior Publication Data

US 2010/0179721 A1 Jul. 15, 2010

(30) Foreign Application Priority Data

Jun. 1, 2007 (GB) ..... 0710524.0
Jun. 27, 2007 (GB) ..... 0712521.4

(51) Int. Cl.
*G07C 5/08* (2006.01)
*G06G 7/48* (2006.01)

(52) U.S. Cl. ..... 701/31.4; 701/32.7; 701/33.4; 703/8; 702/89; 702/182

(58) Field of Classification Search ..... 701/33, 701/31.4, 32.7, 33.4; 703/8; 702/182, 89
See application file for complete search history.

(56) References Cited

U.S. PATENT DOCUMENTS

| | | | | |
|---|---|---|---|---|
| 5,365,436 | A | 11/1994 | Schaller et al. | |
| 6,064,970 | A * | 5/2000 | McMillan et al. | 705/4 |
| 6,745,151 | B2 * | 6/2004 | Marko et al. | 702/182 |
| 7,818,098 | B2 * | 10/2010 | Koepf et al. | 701/1 |
| 7,970,496 | B2 * | 6/2011 | Koepf et al. | 701/1 |
| 2003/0074118 | A1 | 4/2003 | Rogg et al. | |
| 2003/0216889 | A1 * | 11/2003 | Marko et al. | 702/182 |
| 2005/0137757 | A1 * | 6/2005 | Phelan et al. | 701/1 |
| 2006/0025897 | A1 * | 2/2006 | Shostak et al. | 701/1 |
| 2006/0030980 | A1 * | 2/2006 | St. Denis | 701/29 |

(Continued)

FOREIGN PATENT DOCUMENTS

WO 2007030267 3/2007

*Primary Examiner* — Thomas Black
*Assistant Examiner* — Wae Louie
(74) *Attorney, Agent, or Firm* — Crawford Maunu PLLC

(57) ABSTRACT

A method and device for creating an accurate simulation or model of the performance of a vehicle or an internal combustion engine in accordance with the invention comprises accessing the engine on-board diagnostic port (OBD), reading data from the desired industry standard parameter indicators (PID), using these data to produce a basic simulation of the engine operating characteristics, accessing and reading non-industry standard PIDs and using the output from the basic simulation in order to identify the non-industry standard PIDs with a high degree of certainty. As it may not be possible to identify some or all of the required non-industry standard PIDs or their scale due to timing delays or coding, an additional feature of the invention is to prompt a driver of a vehicle to drive the vehicle in a certain way or to perform a certain operation of the engine in order to trigger an event which will assist in identifying the missing non-industry standard PID(s) or will increase the degree of correlation or certainty in identifying the function or the scale of the said non-industry standard PID.

22 Claims, 4 Drawing Sheets

U.S. PATENT DOCUMENTS

2006/0145537 A1* 7/2006 Escott ..... 307/10.1
2007/0078576 A1 4/2007 Salman et al.
2008/0015748 A1* 1/2008 Nagy ..... 701/33
2008/0270009 A1* 10/2008 Spivak ..... 701/105
2009/0027056 A1* 1/2009 Huang et al. ..... 324/439
2010/0023292 A1* 1/2010 Willard et al. ..... 702/89
2010/0179721 A1* 7/2010 Willard et al. ..... 701/33
2011/0307140 A1* 12/2011 Higgins ..... 701/29

* cited by examiner

ENGINE MONITORING

This invention relates to engine and vehicle monitoring and more specifically to a method and a device for extracting and identifying power train operating data from a vehicle on-board diagnostics port (OBD) for use by a vehicle monitoring device (VMD).

BACKGROUND

Communications between the engine controller of a motor vehicle and off-board devices are becoming more standardised. This is mainly due to the development of OBD II legislation in California, which has been propagated across the US and Europe and is now being taken on by many other countries. The legislation requires the support of certain standard communications protocols and also the provision of certain standard pieces of data by those protocols. This is intended to allow the vehicle service industry access to information from sensors and actuators on the vehicle such they can make effective and efficient repairs to vehicles. This information can also be accessed by any other monitoring device that might be fitted to the vehicle, and is not restricted to dealer service tools.

However, across the entire fleet of vehicles with differing engine types and configurations, there are relatively few truly "common" pieces of information (eg common parameters exist for engine rpm and engine coolant temperature). Therefore, in practice, many of the parameters are available only as "manufacturer specific" items. This includes not just the parameter identifier (PID), but also any scaling information that might be required to decode it.

STATEMENT OF THE INVENTION

A method for creating an accurate simulation or model of the performance of a vehicle or an internal combustion engine in accordance with the invention comprises accessing the engine on-board diagnostic port (OBD), reading data from the desired industry standard parameter indicators (PID), using these data to produce a basic simulation of the engine or vehicle operation, accessing and reading signals from the non-industry standard PIDs and using data from the basic simulation in order to identify the non-industry standard PIDs required to construct the accurate simulation.

As it may not be possible directly to identify some or all of the non-industry standard PIDs or their scale due to timing delays or coding, an additional feature of the invention is to prompt a driver of the vehicle to drive it in a certain way or to perform a certain operation of the engine in order to trigger an event that will assist in identifying a certain non-industry standard PID or will increase the degree of correlation or certainty in identifying the function or the scale of the required non-industry standard PID(s).

The data from some or all of the identified non-industry standard PIDs can then be used to run an accurate simulation of the engine using data which can be retrieved over the OBD port, and without additional sensors, or the need to 'break into' vehicle control circuits which could produce mal-function or be dangerous. The resulting data may then be used to produce accurate real time fuel consumption data and/or accurate indications of $CO_2$, oxides of nitrogen, hydrocarbons and/or particulates emitted in the exhaust.

Data from the required PIDs are preferably used to populate an array or matrix which can be subsequently extracted by the engine model to produce and maintain the accurate simulation of the engine performance in real time by using outputs partly or solely obtained from the industry standard PIDs, for example, throttle opening, speed, engine speed, exhaust gas temperature, etc. This permits the simulation to operate or continue to operate even when some or all of the non-industry standard PIDs are not available or are severely delayed due to a high level of activity by the on-board controller or otherwise.

As some data in the array may be missing from driving the vehicle in an ad hoc fashion, the device may be programmed to prompt a driver of a vehicle equipped with the device to drive the vehicle in a certain way or to perform a certain operation of the engine in order to trigger an event, such as to operate a turbo charger, or coast down hill, which will permit missing data in the array to be collected to complete the array.

On return to base, or if required by wireless transmission, fuel consumption and/or emissions may be output from the device to be monitored. In addition, a driver's performance may be monitored by highlighting fuel consumption under various load conditions, or by identifying rapid acceleration or hard braking, which can be extracted from the VMD by performing speed/time calculations. In addition, a signal indicating the arming of the vehicle's airbags (in advance of their being inflated) is available through the OBD port and can alert a vehicle operator to serious driver-related incidents.

The invention extends to a vehicle monitoring device comprising a processor programmed to simulate the operation of an internal combustion engine or vehicle both at a basic level and at an accurate level, an input connection to the processor adapted to connect to the on board diagnostics port (OBD) of the engine, means for interrogating the OBD to acquire data from signals identified by industry-standard parameter indicators (PID) as required for the processor to be able to create and run a basic model of the engine or vehicle operation, and means for interrogating the OBD in order to acquire in real time the available signals identified by the non-industry standard PIDs, and processing means for analysing and comparing the signals identified by the non-industry standard PIDs with data from known parameters obtained from the basic model of engine operation in order to identify the non-industry standard PIDs with a degree of confidence so that their data can be used to produce the accurate model of the engine or vehicle operation in real time.

The device may be programmed to prompt a driver of a vehicle equipped with the device to drive the vehicle in a certain way or to perform a certain operation of the engine in order to trigger an event which will assist in identifying a certain non-industry standard PID or will increase the degree of correlation or certainty in identifying the function or the scale of the non-industry standard PID. The device can thus be programmed to correlate a number of identified desired non-industry standard PIDs with available industry standard PIDs in order to construct and operate an accurate model of the operation of the vehicle engine.

In order to permit the vehicle monitoring device to function properly even when the desired non-industry standard inputs are not available or too delayed to be of use for operating the model in real time, the non-industry standard PID inputs can be saved in an array or matrix referenced to the industry standard PID inputs. Thus accurate simulated PID readings for the vehicle monitoring device can be obtained or maintained in real time from the array based on data supplied by industry standard PIDs.

Over the life of a vehicle and its engine, engine management conditions will change. The device as programmed in accordance with the invention is intended to be left connected to the OBD port throughout the life of the vehicle. This allows the device to continue taking samples of data from the non-industry standard PIDs in order to update the array so that the model of vehicle operation remains accurate over its whole lifetime in spite of the changes to the vehicle and the engine, or even changes in fuel quality.

As the vehicle device is normally intended to be simple to fit and to remain in the vehicle over its lifetime, it is preferably provided with a standard OBD plug which plugs directly into the OBD port and replicates the original fitting so that the OBD port can be accessed as before by a garage or service centre as before without disconnecting the vehicle monitoring device.

An alternative version designed as a universal testing device is provided with a connection to the vehicle's OBD port or equivalent. In this case, or where the device is used on a fleet of similar vehicles, information about the non-industry standard PID(s) may be pre loaded or transferred to the data array to reduce the set-up time.

This invention overcomes the problem of unknown parameter identifiers and unknown scalings to allow the vehicle monitoring device to request parameter information from the on-board controller.

The invention is equally applicable to compression ignition or spark (or spark-assisted) ignition engines, as it is to cars, vans and trucks.

ADVANTAGES

The system can eliminate the need to use manufacturer-specific tools to retrieve information from the sensors fitted to the engine/vehicle.

The system allows a single monitoring device/tool to be used on multiple vehicle/engine types from different manufacturers without the need to consult the detailed service information for each type and programme the monitoring device separately with the PID for each piece of data to be requested.

The system eliminates the need for the separate scaling information to be programmed into a monitoring device for each PID to be requested.

The system can identify when vehicle manufacturers have used alternative sensor arrangements and can identify the pertinent information required by a vehicle monitoring device.

It can be plugged directly into the standard OBD port without 'breaking into' the vehicle electronics (which in most countries is not permitted anyway), and leaves a replica of the original OBD port for servicing or normal testing and diagnostics.

APPLICATIONS

In one application of the invention, due to the increasing costs of fuel and other running costs, it has become advantageous for fleet operators to accurately monitor the fuel consumption of the vehicles within a fleet. The monitoring may be performed remotely—by the use of remote telemetry equipment or may be performed by relaying the information directly to the driver via a visual display unit.

In order to accurately determine fuel consumption in real time is advantageous to intercept the data pertaining to actual fuel quantity injected directly from the on-board engine control unit computer (ECU). Previous attempts to perform this task have involved 'breaking in' to the Controller Area Network. However, the data available on this older system may be insufficiently accurate for meaningful fuel consumption monitoring to be achieved.

In another example, the required PIDs are identified to permit a VMD to make an accurate real-time calculation of tail-pipe emissions, such as $CO_2$, particulates, and even NOX.

Equally, the data collected can be used to monitor and improve a driver's behaviour or a basis for instruction as to how to reduce fuel consumption by avoiding rapid acceleration and hard braking. In extreme circumstances frequent arming of the vehicle's airbag system is likely to indicate a dangerous driver allowing timely and appropriate action to be taken by a vehicle operator.

In another application the vehicle monitoring device can be set up as a universal vehicle testing device to be used with virtually any vehicle equipped with an OBD/OBDII port. The device may be supplied already with a range of known non-industry-standard PIDs already in a data array attached to the engine model. As the device is used increasingly the database will be expanded and it may not always be necessary to drive the vehicle to confirm the identity of all of the required parameters to test the engine or the vehicle.

DETAILED DESCRIPTION

The invention will now be described by way of example with reference to the accompanying drawings in which.

Figure 1:
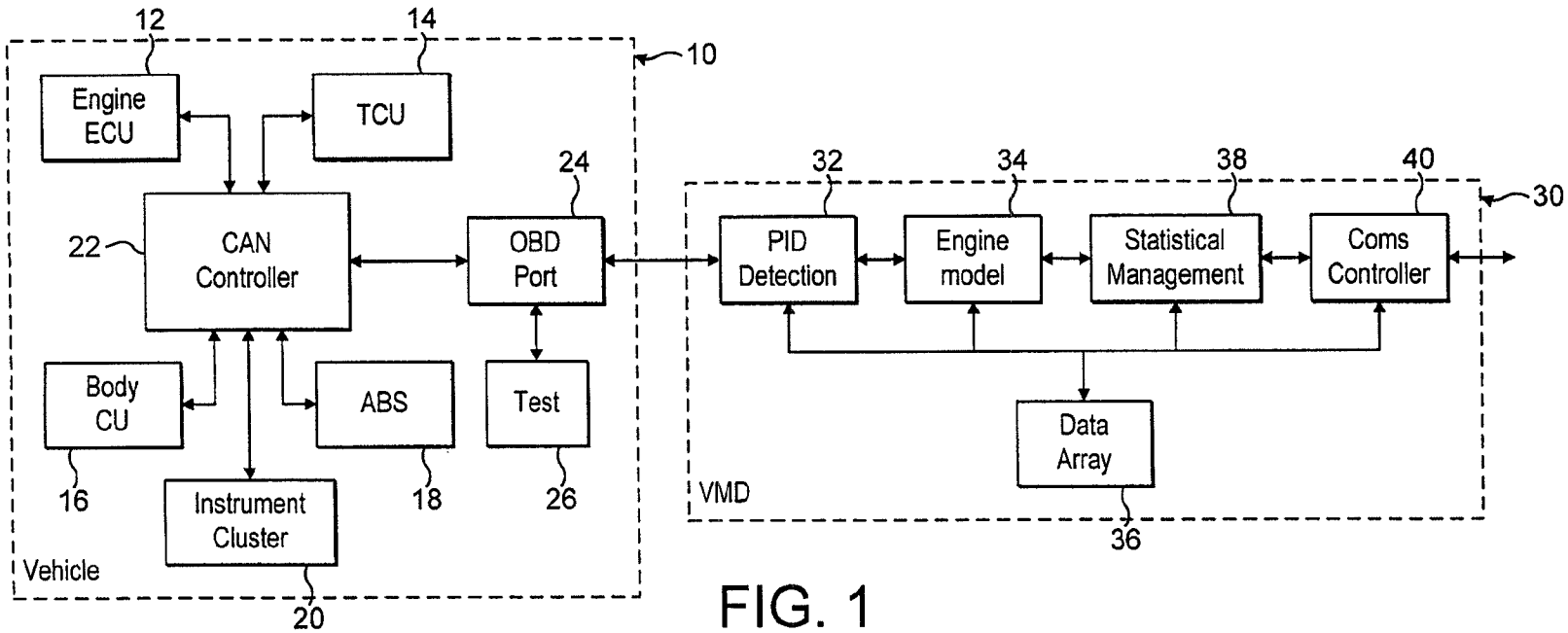
FIG. 1 is a block diagram showing schematically the key units of a vehicle data bus and CAN network controller and the link with a vehicle monitoring device (VMD) in accordance with the invention.
Figure 2:
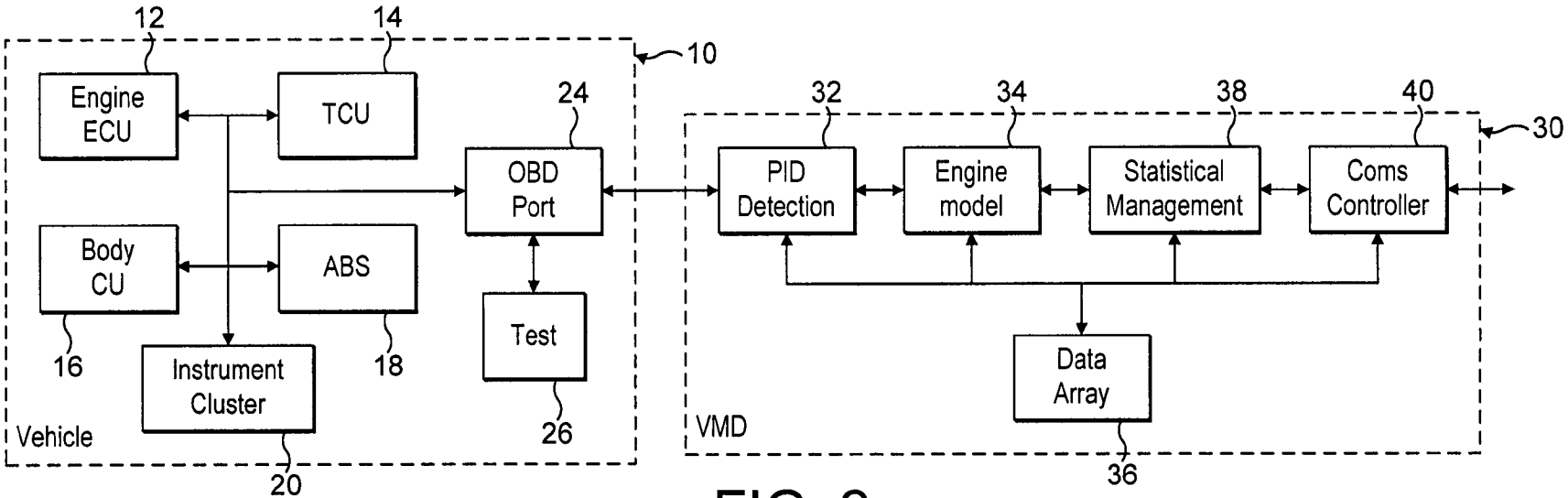
FIG. 2 is similar to FIG. 1, but shows the VMD connected to a different arrangement of the vehicle data bus.
Figure 3:
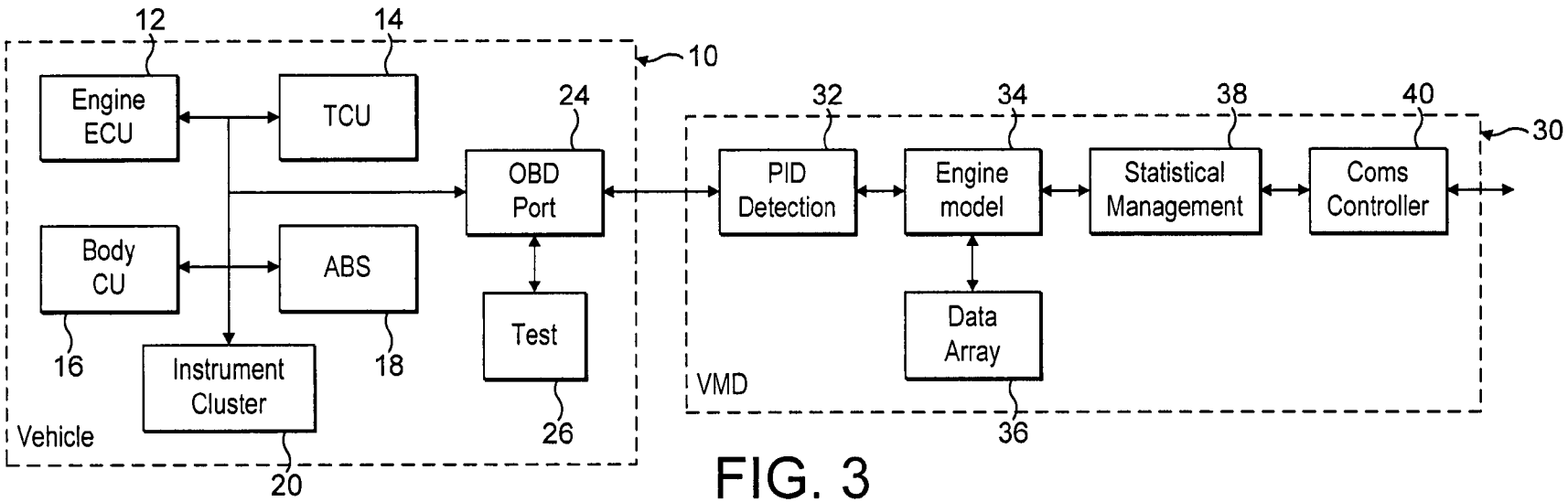
FIG. 3 is similar to FIG. 2 but shows a different arrangement of the data array in the VMD.
Figure 4:
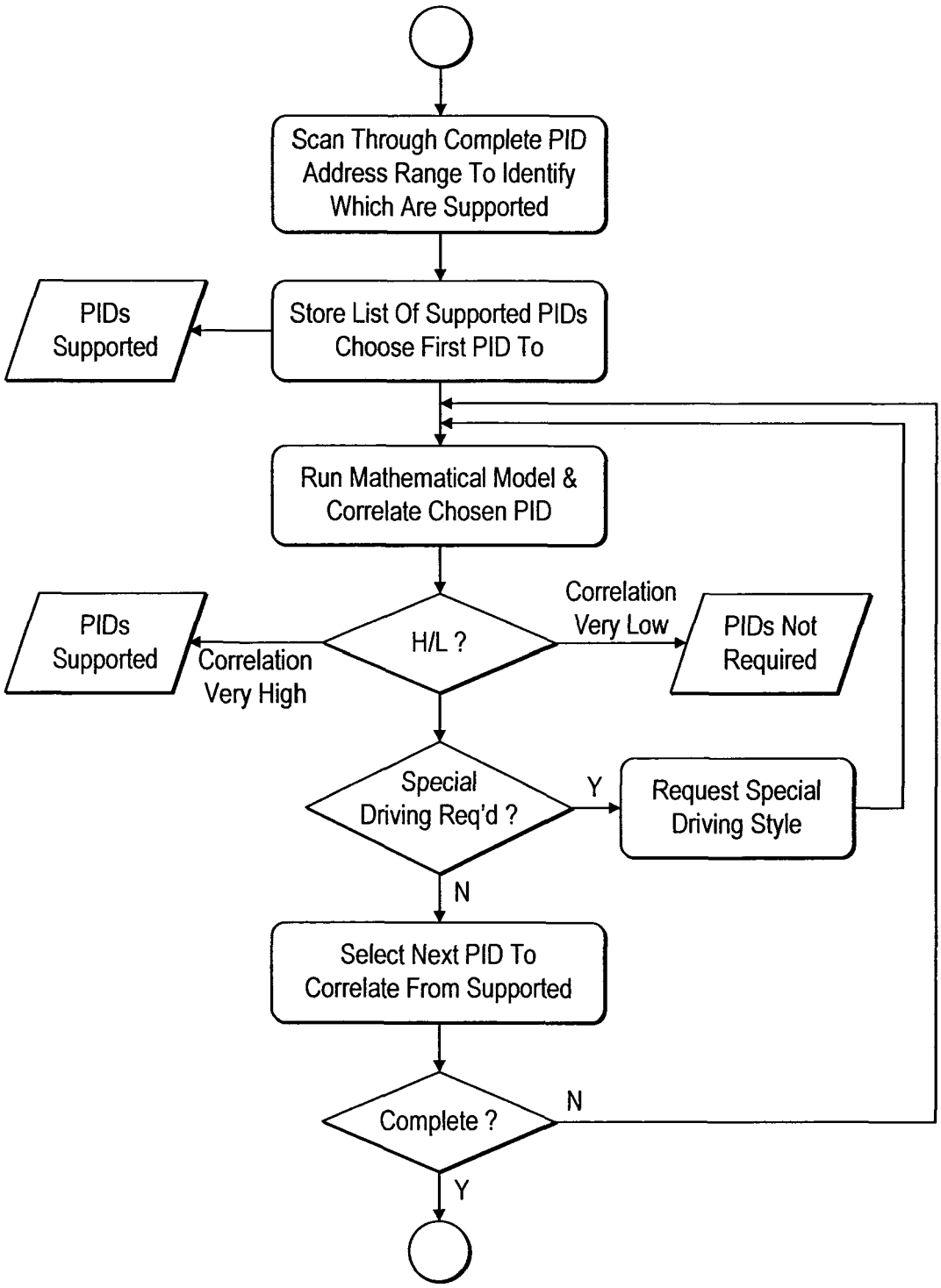
FIG. 4 is a logic flow diagram showing the process in accordance with the invention to identify the various parameter identifiers (PIDs) needed to obtain the data required to produce the desired outputs.

It should be noted that the block diagrams in FIGS. 1, 2 and 3, and the logic flow diagram in FIG. 4 are equally applicable to compression ignition or spark (or spark-assisted) ignition engines, as they are to cars, vans and trucks.

Referring to FIG. 1 on the left hand side the block 10 indicated in broken lines represents equipment supplied with the vehicle and the vehicle data bus. Typically this includes an engine control unit (ECU) 12, a transmission control unit (TCU) 14, a body control unit (BodyCU) 16, ABS control unit 18 and an instrument cluster 20. These control units are connected to a network controller 22; in this example, a CAN network controller is used.

Although CAN network controllers are widely used in vehicles there are many other protocols and architectures that are used by vehicle manufacturers, and many of these are described in the Robert Bosch Automotive Handbook 97$^{th}$ Edition, July, 2007) published by Robert Bosch GmbH, Postfach 1129, D-73201 Plochingen, Germany; and English translation of the Handbook is distributed by John Wiley & Sons Ltd Chichester, England.

An on-board diagnostics (OBD) port 24 is provided giving access to the network controller 22 so that the required signals and industry standard parameters can be accessed for servicing and for diagnostics on the vehicle. Often manufacturers add other manufacturer-specific parameters which can be decoded by using their own diagnostic equipment. However a very wide range of signals and information can be accessed over the OBD port 24; the difficulty arises in identifying what they represent, decoding them and scaling them so as to be meaningful.

The purpose of the present invention is to present a method for identifying and scaling those signals that are useful and allow the various real-time calculations to be performed. The signals have to be identified with a high degree of probability, decoded and scaled so that they can be used reliably to produce an accurate model of the power train 12, 14 and vehicle performance.

In the invention, a vehicle monitoring device (VMD) 30 shown in broken lines is plugged into the OBD port 24 with a T-plug (not shown) leaving access to the OBD port for normal diagnostics and servicing by a test port 26.

The VMD 30 for convenience is broken down by function. It comprises a PID detection unit 32 linked to an engine model unit 34. As described below the engine model 34 interrogates the PID detection unit 32 for certain known parameters that use industry standard codes, such as engine speed, road speed, accelerator position, coolant temperature, etc. These are used to construct an approximate model of the operation of the vehicle based on empirical data. The engine model then looks for specific, otherwise unobtainable, data which is coded. During a drive cycle or by simulation the engine model matches various signals from the vehicle controller network and assigns a degree of correlation and probability to various signals. This part of the process is managed by a statistical management unit 38 connected to the engine model.

Often, some of the required signals may not be available over the vehicle network, or may be severely delayed depending on the amount of activity of the vehicle network. Thus, so that the engine model 34 can continue to function accurately even when these data are not available, the engine populates an array of stored values in a data array 36 so that the values can be looked up if they are not available from the vehicle network.

The statistical management unit 38 may also be used to store fuel consumption and emissions statistics which can be read out on return to base or by wireless communication via a communications (corns) controller 40. Other statistical data or incident data may be stored in the unit 38, such as information relating to driver behaviour that can be deduced not only from fuel consumption and load data, but also from rapid acceleration or hard braking calculated from the vehicle speed/time relationship. Also pre-arming of the airbag circuits or safety system circuits including stability control can be recorded as this is directly available from the OBD port 24.

The VMD 30 shown in FIG. 2 is identical to that shown in FIG. 1, but the vehicle architecture 10 differs from that in FIG. 1 in that a higher baud rate is obtained by direct connection between the various elements so that they 'speak' directly to each other and are programmed to recognise and respond to the data. The VMD 30 operates in a similar way to that in FIG. 1, though the programming will need to be adapted accordingly.

The vehicle architecture 10 shown in FIG. 3 is similar to that in FIG. 2, but the VMD 30 shows the data array 36 as being controlled solely and is accessible directly through the engine model. As a variant, it would be equally suitable in use with a CAN network controller 22 shown in FIG. 1.

Recent OBD legislation requires vehicle manufacturers to make available sensor information from on-board the vehicle to allow the service industry to make efficient and effective repairs. This legislation has been primarily focused on engine emission control systems. This is done by the use of parameters which are sent over a standardised communications system between the on-board engine computer and an off-board tool or monitoring device, using a defined protocol (eg ISO-15031). These various parameters have to be requested by the off-board monitoring device by it requesting a certain parameter ID-PID.

There is a short standard list for the most common sensors (parameter data). This uses Mode 1 of the communications protocol which included the requirement for fixed scalings for these standard parameters. However, the majority of sensors/actuators used on many engines/vehicles do not fall into this category. These are known as manufacturer defined PIDs and are treated differently by the communications standard. The standard uses a separate mode (Mode 22) for the off-board tool/monitoring device to request the parameter by a simple Parameter ID (PID). The parameter ID (PID) must lie within a given address range, but beyond that, all details are left to the vehicle manufacturer. Therefore the manufacturer may use any PID within the range to represent any particular sensor's data and may scale that data in any way. Some PIDs are also used to represent state information and may therefore be bit-mapped rather than a representing a single piece of data.

The monitoring device/tool can be programmed to scan through the complete range of data and request each PID in turn to identify which PIDs are supported on this vehicle and what size of data is returned for each. Unsupported PIDs receive a fixed response according to the protocol. However there may still be a list of 50 or more support PIDs, from which the monitoring device/tool needs to identify the dozen or so pieces of data it requires. It is also common practice for manufacturers to use some of the PIDs to supply the same information as the standard Mode 1 PIDs, but perhaps in a higher resolution scaling.

The sequence used in order to achieve this is shown in the logic diagram in FIG. 4. It involves the following steps:

i. statistically correlating received PID data with mathematical models of the engine and emissions systems.
ii. identifying when a particular sensor's data is being transmitted in response to one particular PID request within a range of possible PID requests.
iii. identifying the scaling of certain parameter data transmitted in response to a PID request, and
iv. requesting PID data in a certain order to build up a complete understanding of all PID data required by a vehicle monitoring device or tool.

The so-called 'scan tools' are capable of reading Mode 22 PIDs providing they know what to look for and have the sequences to hand. They cannot resolve the Mode 22 PIDs ab initio. However, this could be achieved by evesdropping on the communications between the OBD port and the OEM diagnostics device.

The resulting PID data may be used to populate a table or matrix so that such data are available and can be accessed as required by the VMD. In the event that inadequate data is retrieved in order to populate the table or build up a complete understanding of the operation of the power-train, the device may be programmed to prompt the driver to operate the engine under various specific conditions in order to complete the table.

The system requests PIDs at regular intervals as the vehicle is driven. During this time, the system also runs a mathematical model of the engine, given the basic information from the Mode 1 PIDs to ensure that the model tries to emulate the same operation as the real engine. The model predicts the value of the PID that is being requested and the system compares the model with the PID value returned. The system attempts to statistically correlate the model data with the PID value to determine if this PID contains data from the sensor in question. A measure of confidence is built up over time. If the confidence measure becomes either extremely high or extremely low, then the PID is recognised as definitely the same or definitely different to the model value and therefore can be used or ignored.

There are various errors with the system which have to be taken into account by the statistics. The mathematical model itself is based on limited input data and therefore will have its own errors associated with the estimated parameter. The PID request/response takes a certain amount of time, therefore the parameter value received back at the tool/monitoring device may have errors as the model timesteps are not synchronised with the receipt of PID values. For these reasons, the statistical correlation will never be 100% perfect, hence the use of a confidence measure.

The PID scaling needs to be considered, as some manufacturers may scale the data differently. However, given the definition of the communications protocol and the knowledge of the physical range of the parameter in question, the system will have a limited number of possible scalings. They are also likely to vary in powers of 2, to fit the limited space in the Mode 22 message structure.

It is possible that a manufacturer may make the same parameter data available with a different range/resolution/scaling. In this case if two PIDs are identified as potentially matching the parameter required by the tool/monitoring device, then the one with the finer resolution will be selected.

The system continues in this way to identify the PIDs that are required. Once a PID has been recognised, then the system uses that parameter as part of the model and so the mathematical model is enhanced and its own errors reduced as the system recognises each PID. This is why the order in which PIDs are recognised can significantly enhance the timeliness and accuracy of the whole process.

As an alternative to allowing the vehicle to drive over random conditions, the tool/vehicle monitoring device may prompt the driver to operate the vehicle in a specific manner such that the recognition of (a) particular PID(s) may be speeded up. For example a long coast down, in gear, from high speed will exhibit different responses to normal driving patterns, similarly cold starting or steady speed or wide open throttle will all exhibit certain conditions which allow PIDs to be detected more efficiently.

We can also listen to the Controller Area Network (CAN) by going through the OBD system. The OBD is effectively 'powered' by the CAN. If on the other hand there is no OBD port available (and this includes the J1939 truck standard—a cut down version of OBD for heavy trucks)—then you need to break into the CAN. However all Euro 3 vehicles have some kind of available diagnostics system.

Some vehicles may use standards other than CAN which is a protocol and architecture originally developed for machine tools. However, in order to benefit from the invention you do not need to have access to the CAN; BMW and Porche, for example, use K-line (ISO 9041).

The mathematical engine models may be contained within the software of a vehicle monitoring device or alternatively may be within a separate tool.

The invention claimed is:

1. A vehicle monitoring device comprising:

a processor programmed to simulate the operation of an internal combustion engine or vehicle both at a first level and a second level;

an input connection to the processor adapted to connect to an on board diagnostics port (OBD) of the engine;

means, including a processor circuit, configured and arranged to interrogate the OBD to acquire data from signals identified by first parameter indicators (PID) as required for the processor to be able to create and run a first model of the engine or vehicle operation, and acquire in real time available signals identified by second PIDs that are different than the first PIDs and not required for the processor to create and run the first model; and processing means, including a processor circuit, configured and arranged to analyze and compare the signals identified by the second PIDs with signals obtained or derived from the first model of engine operation, and based on the analyzing and comparing, identify at least one of the second PIDs to the processor, the processor being configured and arranged to use the at least one of the identified second PIDs to simulate the engine or vehicle operation at the second level.

2. A device as claimed in claim 1 which is programmed to prompt a driver of a vehicle equipped with the device to drive the vehicle in a certain way or to perform a certain operation of the engine or vehicle in order to trigger an event which will assist in identifying a certain second PID or will increase the degree of correlation or certainty in identifying the function or the scale of the second PID.

3. A device as claimed in claim 1 which is programmed to correlate a number of identified desired second PIDs with available first PIDs, and to use the correlated second PIDs to construct an accurate model of the operation of the vehicle and/or its engine.

4. A device as claimed in claim 3 in which the signals identified by the second PIDs to the accurate model are used to generate coefficients to populate an array with reference to the first PID inputs, and the device is configured and arranged to obtain or deduce the accurate coefficients in real time from the signals from the first PIDs if or when second PID inputs are not available or too delayed to be of use.

5. A device as claimed in claim 4 which is programmed to prompt a driver of a vehicle equipped with the device to drive the vehicle in a certain way or to perform a certain operation of the engine in order to trigger an event which will permit missing data in the array to be collected to complete the array.

6. A device as claimed in claim 4 in which the data array is preprogrammed with known second PID(s) or with data extracted from other vehicle monitoring devices and transferred to the array.

7. A device as claimed in claim 1 which is provided with a plug for connection to the vehicle OBD port, and a port that replicates the vehicle OBD port so that servicing and maintenance of the vehicle can be carried out through the replicated port without removing the device.

8. A device as claimed in claim 4 which is programmed to monitor some or all of the second PIDs constantly or intermittently in order to permit accuracy of the accurate model and/or the array to be maintained or updated.

9. A device as claimed in claim 1 which is programmed to interrogate the vehicle or engine network controller to retrieve certain signals or parameters to enable it to calculate, deduce or output fuel use directly.

10. A device as claimed in claim 1 which is programmed to interrogate the vehicle or engine network controller to retrieve certain parameters to enable it to create an accurate model of the vehicle or engine operation whence accurate data can be calculated or deduced relating to fuel consumption and/or emissions.

11. A device as claimed in claim 1 in which the device stores speed/time data enabling acceleration and braking rates to be calculated or retrieved.

12. A device as claimed in claim 1 in which the device is programmed to identify a PID relating to arming of the vehicle's air bags or safety systems and records or stores each event.

13. A device as claimed in claim 1, wherein the respective processor and processor circuits are a common processor executing different programming to carry out the respective operations, and the device is configured and arranged to process the second PID data to detect information relating to driver behavior from at least one of fuel consumption, load data, rapid acceleration, and hard braking calculated from a vehicle speed/time relationship.

14. A device as claimed in claim 1 in which the device is self-standing and arranged for use as a universal engine testing device and programmed to recognise various vehicles and store their second PIDs for reference and future use.

15. A method for creating an accurate simulation or model of the performance of an internal combustion engine comprising the steps of:

accessing an on-board diagnostic port (OBD) for the engine, reading, from the OBD port, data from first parameter indicators (PID) according to a first standard, using the read data to produce a basic simulation of engine or vehicle operation, accessing and reading signals, from the OBD port, from second PIDs according to a second standard that is different than the first standard, and using data from the basic simulation to identify at least one of the signals for the second PIDs to run an accurate simulation of the engine or vehicle operation.

16. A method as claimed in claim 15 in which a driver of a vehicle is prompted to drive the vehicle in a certain way or to perform a certain operation of the engine in order to trigger an event which will assist in identifying a certain second PID or will increase the degree of correlation or certainty in identifying the function or the scale of the second PID.

17. A method as claimed in claim 15 in which data from the identified second PIDs are used to run the accurate simulation of the engine.

18. A method as claimed in claim 15 in which data from the required PIDs are used to populate an array which can be used subsequently to produce the accurate simulation of the engine performance in real time by using outputs partly or solely from the first PIDs.

19. A method as claimed in claim 18 in which a driver of a vehicle equipped with the device is prompted to drive the vehicle in a certain way or to perform a certain operation of the engine in order to trigger an event which will permit missing data in the array to be collected to complete the array.

20. A method as claimed in claim 15 in which accessing and reading signals includes continuously or intermittently interrogating some or all of the second PIDs to update their values as the vehicle operating conditions change over time.

21. An apparatus comprising:

an input circuit connection configured and arranged to connect to an on board diagnostics (OBD) port of a vehicle; and a processor circuit connected to the input circuit connection for communicating with the OBD port and configured and arranged to simulate the operation of the vehicle by interrogating the OBD to acquire data from signals identified by first parameter indicators (PID) required to create and run a first model of the vehicle operation, acquiring in real time available signals identified by second PIDs that are different than the first PIDs, analyzing and comparing the signals identified by the second PIDs with signals obtained or derived from the first model of engine operation, and based on the analyzing and comparing, identifying and using at least one of the second PIDs to simulate the vehicle operation.

22. The apparatus of claim 21, wherein the processor circuit is configured and arranged to use the signals identified by at least one of the second PIDs to detect information relating to driver behavior from at least one of fuel consumption, load data, rapid acceleration, and hard braking calculated from a vehicle speed/time relationship.

* * * * *